US007825572B2

(12) United States Patent
Nakayama et al.

(10) Patent No.: US 7,825,572 B2
(45) Date of Patent: Nov. 2, 2010

(54) SPARK PLUG

(75) Inventors: Katsutoshi Nakayama, Nagoya (JP); Hiroyuki Kameda, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 271 days.

(21) Appl. No.: 11/851,030

(22) Filed: Sep. 6, 2007

(65) Prior Publication Data

US 2008/0061670 A1 Mar. 13, 2008

(30) Foreign Application Priority Data

Sep. 7, 2006 (JP) ..... 2006-242332
Aug. 7, 2007 (JP) ..... 2007-204941

(51) Int. Cl.
*H01T 13/20* (2006.01)

(52) U.S. Cl. ..... 313/143; 313/118

(58) Field of Classification Search ..... 313/118, 313/143, 144, 141, 135
See application file for complete search history.

(56) References Cited

U.S. PATENT DOCUMENTS

| | | | | |
|---|---|---|---|---|
| 3,800,179 | A * | 3/1974 | Louzecky | 313/118 |
| 5,144,188 | A * | 9/1992 | Kagawa et al. | 313/11.5 |
| 5,697,334 | A | 12/1997 | Below | |
| 5,918,571 | A | 7/1999 | Below | |
| 6,104,130 | A | 8/2000 | Below | |
| 6,414,420 | B1 * | 7/2002 | Suzuki | 313/144 |
| 6,819,030 | B2 * | 11/2004 | Lipp et al. | 313/118 |
| 7,400,081 | B2 * | 7/2008 | Ishiguro | 313/143 |
| 2001/0002096 | A1 * | 5/2001 | Honda et al. | 313/143 |
| 2003/0168955 | A1 | 9/2003 | Suzuki | |
| 2005/0168121 | A1 * | 8/2005 | Tinwell | 313/141 |
| 2007/0159047 | A1 * | 7/2007 | Ishinada | 313/143 |

FOREIGN PATENT DOCUMENTS

| | | | |
|---|---|---|---|
| EP | 1 059 714 | A1 | 12/2000 |
| GB | 2219624 | A * | 12/1989 |
| JP | 55-65795 | | 10/1978 |
| JP | 56-9689 | | 7/1979 |
| JP | 62-79948 | U | 5/1987 |
| JP | 63-490 | U | 1/1988 |
| JP | 2000-504875 | A | 4/2000 |
| JP | 2003-257583 | A | 9/2003 |
| JP | 2006-012464 | A | 1/2006 |

OTHER PUBLICATIONS

Japanese Office Action dated Jan. 20, 2009.

* cited by examiner

*Primary Examiner*—Peter J Macchiarolo
*Assistant Examiner*—Glenn Zimmerman
(74) *Attorney, Agent, or Firm*—Sughrue Mion, PLLC

(57) ABSTRACT

A spark plug including a center electrode; an insulator; and a metal shell, wherein the metal shell includes: a mounting portion; a cylindrical portion; a seal portion; a crimping portion; and a buckled portion all as defined herein, and a relationship A<B is satisfied, in which A is a length in the axial direction of an external thread formed on the mounting portion, and B is a length of the cylindrical portion in the axial direction.

10 Claims, 2 Drawing Sheets

SPARK PLUG

BACKGROUND OF THE INVENTION

1. Field of the Invention

The present invention relates to a spark plug which is mounted in an internal combustion engine to ignite an air-fuel mixture.

2. Description of the Related Art

Conventionally, a spark plug for ignition is used in an internal combustion engine such as an automobile engine. A spark plug generally includes a center electrode forming a spark discharge gap on its leading end side; an insulator having an axial hole for holding the center electrode; and a metal shell radially surrounding and holding the periphery of the insulator. An external thread is formed on an outer peripheral surface of the metal shell so as to engage an internal thread formed in a mounting hole provided on the engine side for mounting the spark plug. Furthermore, the spark plug is mounted in the engine to ignite the air-fuel mixture by a spark discharge.

In recent years, trends toward higher power and fuel savings in internal combustion engines are underway. Consequently, there has been a demand for a reduction in the diameter of the mounting hole from the viewpoint of ensuring a high degree of freedom in design of the engine, including, for example, enlarging the exhaust valve diameter for improving exhaust efficiency and providing a dense water jacket arrangement for improving cooling efficiency. Accordingly, a spark plug is known in which the thread (whose diameter is difficult to reduce) is disposed at the rear end side of the outer peripheral surface of the metal shell, and the outer peripheral surface on the leading end side is made thread-free (not formed) (e.g., refer to JP-A-2000-504875 (corresponding to U.S. Pat. No. 5,697,334)). In JP-A-2000-504875 (corresponding to U.S. Pat. No. 5,697,334), the leading end (truncated cone portion) of the metal shell is tapered, and a sleeve formed separately and having a small diameter protrudes from and is retained at the leading end in an axially aligned state. In this state, a spark discharge is carried out at the leading end side of the sleeve, thereby realizing a small diameter in the configuration of the leading end side located forward of the metal shell. By so doing, it is possible to reduce the diameter of the portion where the sleeve is disposed within the mounting hole, i.e., the portion which is close to the combustion chamber. It is also possible to enhance the degree of freedom in the layout of parts disposed in its vicinity and to enlarge the diameter of the exhaust valve and to provide a densely arranged water jacket.

Meanwhile, a spark plug is also known in which the thread is disposed at the rear end side of the outer peripheral surface of the metal shell, the outer peripheral surface on the leading end side is made thread-free (no thread is formed on the leading end side), a tapered seal portion (stepped portion) is provided on the leading end side, and the outside diameter of a portion located forwardly of the stepped seal portion is made small (e.g., refer to JP-A-2006-12464). In JP-A-2006-12464, the configuration is such that the seal portion abuts a stepped portion provided on the inner peripheral surface of the mounting hole so as to retain the spark plug and seal the combustion chamber. However, the length of the axial direction of the clearance between the inner peripheral surface of the mounting hole and the outer peripheral surface of the metal shell, as viewed from the combustion chamber, is restricted by bringing the seal portion closer to the combustion chamber. By doing so, it is possible to restrain entry of foreign substances such as combustion gases and soot into the clearance during operation of the internal combustion engine, thereby making it possible to prevent a decline in thermal conductivity and to satisfactorily effect heat dissipation of the spark plug.

3. Problems to be Solved by the Invention

However, in the spark plug disclosed by JP-A-2000-504875 (corresponding to U.S. Pat. No. 5,697,334), since the sleeve and the metal shell are formed separately, there is a possibility of axial misalignment between the axis of the metal shell and the axis of the sleeve. For this reason, if there is too tight of a fit between the inside diameter of the mounting hole and the outside diameter of the sleeve, there are cases where inserting the spark plug becomes difficult at the time of mounting. Consequently, a large clearance between the inside diameter of the mounting hole and the outside diameter of the sleeve is unavoidably adopted. In this manner, foreign substances such as combustion gases and soot may possibly enter the clearance during operation of the internal combustion engine, causing a reduction in thermal conductivity and a buildup of heat in the spark plug.

On the other hand, in the spark plug described in JP-A-2006-12464, since the seal portion is arranged close to the combustion chamber, the portion located rearwardly of the seal portion and having a large outside diameter is also disposed near the combustion chamber. Hence, the arrangement layout of other parts in the vicinity of the spark plug is restricted, leading to a decrease in the degree of freedom in engine design.

SUMMARY OF THE INVENTION

The present invention has been made to overcome the above-described problems of the prior art, and an object thereof is to provide a spark plug which is capable of dissipating heat satisfactorily while enhancing the degree of freedom in engine design by reducing the diameter of the metal shell.

To attain the above object, in accordance with a first aspect (1), the present invention provides a spark plug comprising: a center electrode; an insulator having an axial hole extending in an axial direction of said spark plug, said insulator holding the center electrode at a leading end side within the axial hole; and a metal shell having a cylindrical hole extending in the axial direction, said metal shell holding at least a portion of the insulator within the cylindrical hole, wherein the metal shell includes: a mounting portion having an external thread formed on at least a portion of an outer peripheral surface thereof for engaging an inner thread of a mounting hole of an internal combustion engine; a cylindrical portion formed integrally with the mounting portion at a leading end side thereof and having a smaller diameter than that of the mounting portion; a tapered seal portion connecting outer peripheral surfaces of the cylindrical portion and the mounting portion; a crimping portion provided at a rear end of the metal shell said, crimping portion holding the insulator within the cylindrical hole by crimping; and a buckled portion provided between the mounting portion and the crimping portion, and adapted to be deformed in conjunction with the crimping of the crimping portion, and a relationship $A<B$ is satisfied, in which A is a length in the axial direction of the external thread formed on the mounting portion, and B is a length of the cylindrical portion in the axial direction.

In a second aspect (2), the spark plug according to (1) above comprises a shelf portion provided on an inner peripheral surface of the cylindrical hole of the metal shell and projecting inwardly, said shelf portion clamping the insulator in the axial direction in cooperation with the crimping portion, and wherein a relationship B>C is satisfied in which C is a length in the axial direction from a leading end of the insulator to a position where the shelf portion is formed.

In accordance with a third aspect (3) of the invention, in the spark plug according to (2) above, the seal portion of the metal shell is located rearwardly of the shelf portion in the axial direction.

In accordance with a fourth aspect (4) of the invention, in the spark plug according to (2) or (3) above, the length A of the external thread in the axial direction is from 10 mm to 20 mm, the length B of the cylindrical portion of the metal shell in the axial direction is from 12 mm to 30 mm, and the length C in the axial direction from the leading end of the insulator to a position where the shelf portion is formed is 12 mm or less.

In the spark plug according to the above-described first aspect, since the mounting portion constituting the metal shell and the cylindrical portion disposed forwardly of the mounting portion and having a smaller diameter than the mounting portion are formed integrally, axial misalignment between the mounting portion and the cylindrical portion is avoided. In addition, the insulator is held within the cylindrical hole of the metal shell by crimping the crimping portion provided at the rear end of the metal shell. Since the buckled portion which is deformed in conjunction with the crimping is provided rearwardly of the mounting portion, the positional relationship between the mounting portion and the cylindrical portion remains unchanged. Also, axial misalignment due to deformation of the buckled portion does not occur. For this reason, if the accuracy in forming the mounting hole of the internal combustion engine is enhanced, and the clearance between the outer peripheral surface of the cylindrical portion and the inner peripheral surface of the mounting hole when the spark plug is mounted in the mounting hole is reduced, the mounting of the spark plug is not made more difficult. A small clearance can restrain foreign substances such as combustion gases and soot from entering the clearance to the detriment of operation of the internal combustion engine. Accordingly, good thermal conductivity between the cylindrical portion and the mounting hole through the clearance is maintained, so that heat dissipation can be sufficiently effected even from the cylindrical portion of the spark plug.

However, the inner peripheral surface of the mounting hole and the outer peripheral surface of the cylindrical portion are not in close contact with one another. Thus, as a configuration for allowing more effective heat dissipation, the length of the cylindrical portion in the axial direction should preferably be longer than the length of the external thread formed on the mounting portion in the axial direction. By specifying the above-described length condition, a large area of the outer peripheral surface of the cylindrical portion may be disposed in proximity to (a part may be disposed in close contact with) the inner peripheral surface of the mounting hole. The seal portion which is in close contact with the mounting hole is provided rearwardly of the cylindrical portion. Consequently, when heat from the combustion chamber is transferred through the interior of the cylindrical portion and is allowed to escape from the seal portion to the mounting hole, part of the heat can be allowed to effectively escape from the cylindrical portion to the mounting hole. Hence, the heat dissipation performance of the spark plug as a whole can be improved, and pre-ignition can be prevented. Furthermore, when a long length small-diameter cylindrical portion is formed, a long portion having a small inside diameter at the leading end side of the mounting hole can be secured. Consequently, the degree of freedom in the arrangement layout of other parts in the vicinity of that portion can be enhanced, leading to an improvement in the degree of freedom in engine design.

In addition, to allow heat transferred from the combustion chamber to the insulator to effectively escape to the metal shell, the shelf portion for supporting the insulator should preferably be provided midway on the cylindrical portion in the axial direction. To realize this configuration, as in the second aspect of the invention, the length of the cylindrical portion in the axial direction should preferably be longer than the length from the leading end position of the insulator to the position where the shelf portion is formed. Heat dissipation to the mounting hole is carried out in the cylindrical portion, as described above. When the shelf portion is formed midway on the cylindrical portion, heat transfer to the cylindrical portion which assumes a lower temperature than the insulator can be effected smoothly. As a result, since heat from the insulator is able to escape to the metal shell at a relatively early stage by passing through a short route at a position closer to the combustion chamber constituting the heat source, it is possible to improve the heat resistance of the spark plug.

As described above, the heat moves toward the seal portion of the cylindrical portion due to heat dissipation from the seal portion, but the heat which has moved from the insulator to the cylindrical portion through the shelf portion also converges to this heat transfer route. At this juncture, if the seal portion is located rearwardly of the shelf portion in the axial direction as in the third aspect of the invention, since the heat transfer route at its converging position is located away from the combustion chamber, i.e., the heat source, heat transfer can be carried out smoothly, and heat dissipation of the insulator can be accomplished more effectively.

As described in the fourth aspect of the invention, preferably, the length A of the external thread in the axial direction is from 10 mm to 20 mm, the length B of the cylindrical portion of the metal shell in the axial direction is from 12 mm to 30 mm, and the length C in the axial direction from the leading end of the insulator to the position where the shelf portion is formed is 12 mm or less.

If the length A is less than 10 mm, in the case where the spark plug is screwed into the engine head with a specified tightening torque, the surface pressure occurring between the contact surfaces of the external thread and the internal thread becomes large. As a result, plastic deformation can occur in the external thread or the internal thread. In that case, it becomes impossible to maintain the surface pressure between the external thread and the internal thread. Consequently, some looseness (play) may be introduced in the tightened state, making it difficult to maintain gastightness of the interior of the combustion chamber.

In general, in the case where tightening of the thread is carried out, the thread is in a state such that the closer the thread portion is to the rear end side in the axial direction, the greater the surface pressure that is applied thereto. If a thermal load is applied in this state, the external thread and the internal thread are respectively elongated with that portion set as an origin. Since the materials of the metal shell and the engine head in which the mounting hole of the internal combustion engine is formed are generally different, their coefficients of thermal expansion differ. As a result, a difference occurs between the overall elongation of the external thread and the overall elongation of the internal thread which are caused by the thermal load. Furthermore, the closer to the leading end side in the axial direction, the closer the thread portion is to the combustion chamber and the higher the temperature, so that the difference in elongation due to the difference in coefficient of thermal expansion becomes large.

For this reason, the closer the external thread is to the leading end side in the axial direction, its deviation from the internal thread becomes large and a strong surface pressure is applied. The longer the length A of the external thread, the more noticeable this deviation becomes. If the length A of the external thread becomes greater than 20 mm, a large surface pressure is applied to the external thread at the leading end side in the axial direction. In turn, the resulting plastic deformation can introduce some degree of play in the tightened state, making it difficult to maintain gastightness.

Next, if the length B of the cylindrical portion is made small, the heat transfer route within the cylindrical portion becomes short. This arrangement is advantageous for heat dissipation of the cylindrical portion itself. However, since the amount of heat conducted to the mounting hole side through the outer peripheral surface of the cylindrical portion becomes small, the amount of heat conducted from the cylindrical portion to the mounting hole side through the seal portion becomes relatively large. For this reason, the amount of heat from the insulator which can be dissipated from the cylindrical portion through the seal portion becomes relatively small. If the length B of the cylindrical portion is less than 12 mm, such a decrease becomes noticeable, and there is a possibility that dissipation of heat from the insulator cannot be accomplished sufficiently.

Although the mounting portion and the cylindrical portion are formed integrally, as described above, the longer the cylindrical portion in the axial direction, the greater the need to increase the forming accuracy of the metal shell in preventing axial misalignment. If the length B is made greater than 30 mm, axial misalignment can occur between the mounting portion and the cylindrical portion. In a case where a portion of the outer peripheral surface of the cylindrical portion comes into contact with the inner peripheral surface of the mounting hole, the gap between the two surfaces becomes large at a portion opposite the contacting portion. Soot and the like entering this gap can possibly fix the outer peripheral surface of the cylindrical portion to the inner peripheral surface of the mounting hole, resulting in seizure.

In addition, to allow effective heat dissipation from the insulator, the length C is preferably not more than 12 mm. If the length C is greater than 12 mm, when the heat received by the insulator is transferred to the metal shell side, the route through which the heat is transferred in the insulator becomes long, possibly resulting in a decrease in heat resistance of the insulator itself.

DESCRIPTION OF REFERENCE NUMERALS

Figure 1:
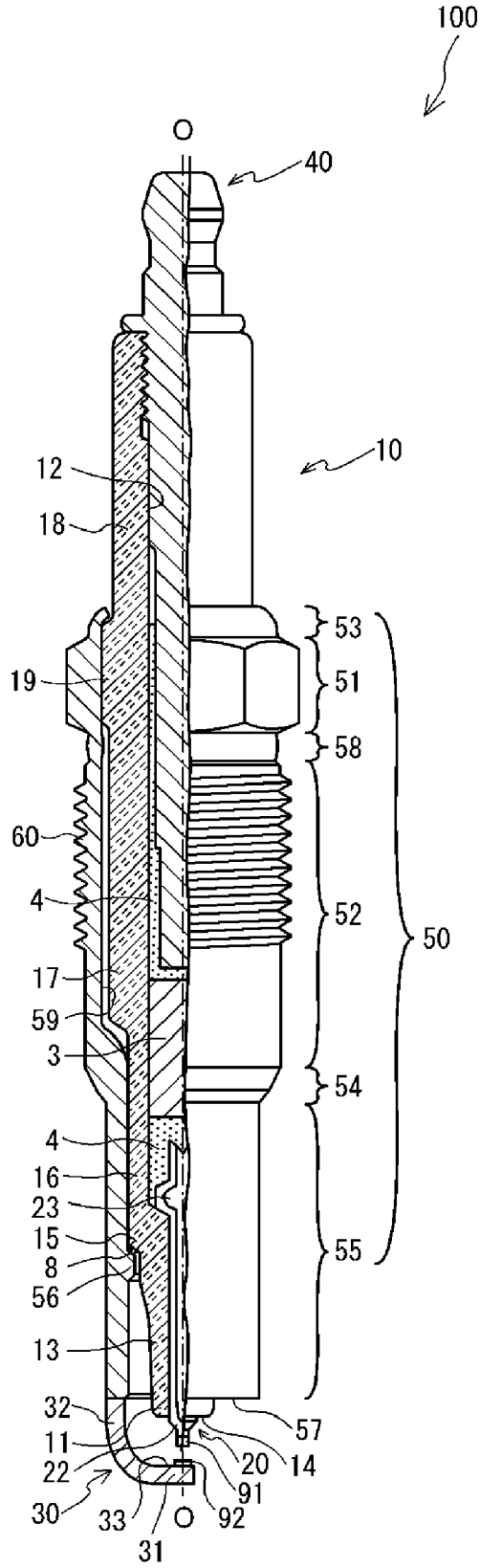
FIG. 1 is a partial cross-sectional view of a spark plug 100.

Reference numerals used to identify various structural features in the drawings include the following.

12: axial hole
14: leading end face
20: center electrode
50: metal shell
52: mounting portion
53: crimping portion
54: seal portion
55: cylindrical portion
56: shelf portion
58: buckled portion
59: cylindrical hole
60: external thread
100: spark plug
205: mounting hole

DETAILED DESCRIPTION OF THE INVENTION

Referring now to the drawings, a description will be given of an embodiment of a spark plug in accordance with the invention. However, the present invention should not be construed as being limited thereto.

Figure 2:
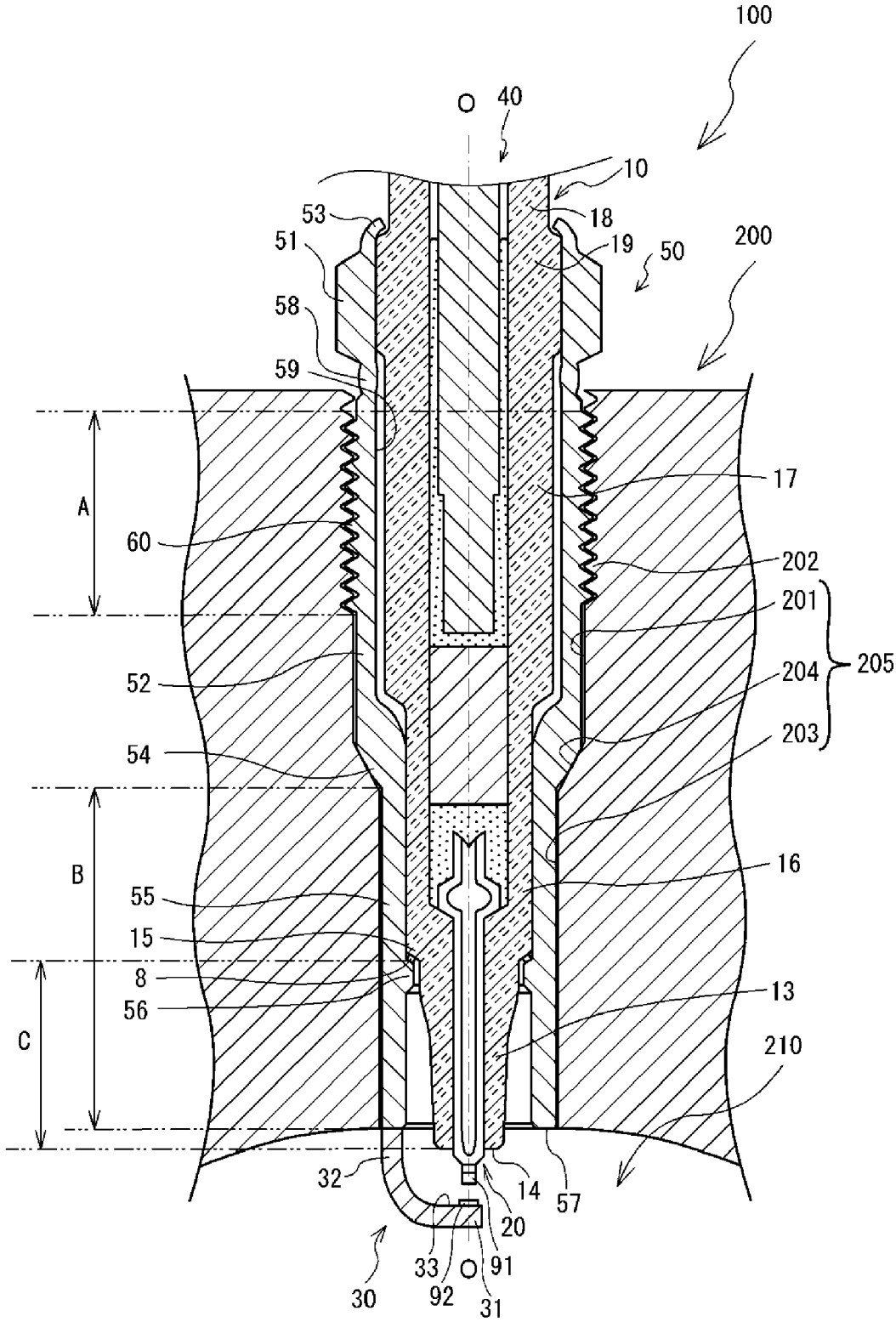
FIG. 2 is a cross-sectional view illustrating spark plug 100 mounted in an engine head 200 of an internal combustion engine.

First, referring to FIGS. 1 and 2, a description will be given of the structure of a spark plug 100 as one example. FIG. 1 is a partial cross-sectional view of the spark plug 100. FIG. 2 is a cross-sectional view illustrating spark plug 100 mounted in an engine head 200 of an internal combustion engine. In FIG. 1, the direction of an axis O of the spark plug 100 is a vertical direction in the drawing, the lower side of the drawing is a leading end side (forward side) of the spark plug 1, and the upper side is a rear end side (rearward side) thereof.

The spark plug 100 shown in FIG. 1 is a small-diameter spark plug in which the nominal diameter of a thread formed on a mounting portion 52 of a metal shell 50, described below, is M12 (12 mm). The spark plug 100 in general has a structure in which insulator 10 holds a center electrode 20 within its axial hole 12 at a leading end side thereof. Metal shell 50 surrounds a radial periphery of the insulator 10, which in turn holds a metal terminal 40 at its rear end side. In addition, a ground electrode 30 is joined to a leading end face 57 of the metal shell 50, and its leading end portion 31 is bent so as to oppose a precious metal tip 91 provided at a leading end of the center electrode 20.

First, a description will be given of the insulator 10 of this spark plug 100. As is generally known, the insulator 10 is formed by sintering alumina or the like, and has a cylindrical shape in which an axial hole 12 extending in the direction of the axis O is formed at its axial center. A collar portion 19 having a largest outside diameter is formed rearwardly of a center in the direction of the axis O, and a rear-end side trunk portion 18 is formed rearwardly of the same (upper side in FIG. 1). A first leading-end side trunk portion 17 having a larger outside diameter than the rear-end side trunk portion 18 and a second leading-end side trunk portion 16 having an outside diameter which is smaller than that of the first leading-end side trunk portion 17 and smaller than that of the rear-end side trunk portion 18 are formed forwardly of the collar portion 19 (lower side in FIG. 1). Further, a long leg portion 13 having a smaller outside diameter than that of the second leading-end side trunk portion 16 is formed forwardly of the second leading-end side trunk portion 16. The long leg portion 13 has a diameter that is gradually reduced toward the leading end side, and when the spark plug 100 is mounted in the engine head 200 (see FIG. 2), the long leg portion 13 is exposed to the interior of the combustion chamber 210. Additionally, a portion between the long leg portion 13 and the second leading-end side trunk portion 16 is formed as a stepped portion 15.

Next, a description will be given of the center electrode 20. The center electrode 20 is formed of, for example, a nickel-based alloy such as INCONEL (trade name) 600 or 601, and has in its interior a metallic core 23 formed of copper or the like excelling in thermal conductivity. The center electrode 20 is held at the leading end side of the interior of the axial hole 12 of the insulator 10 such that its axis is aligned with the axis O of the spark plug 100. A leading end portion 22 of the center electrode 20 protrudes from a leading end face 14 of a leading end portion 11 of the insulator 10, and its protruding portion is formed to have a smaller diameter toward the leading end side. The precious metal tip 91 for improving spark wear resistance is joined to the tip of this protruding portion.

In addition, the center electrode 20 is electrically connected to the metal terminal 40 on the upper side through a seal body 4 and a ceramic resistor 3 provided in the axial hole 12. A high-tension cable (not shown) is connected to the metal terminal 40 through a plug cap (not shown), and a high voltage is applied thereto.

Next, a description will be given of the ground electrode 30. The ground electrode 30 is a rod-like electrode formed of a metal having high corrosion resistance, and a nickel alloy such as INCONEL (trade name) 600 or 601, for example, is used. The ground electrode 30 is formed such that its longitudinal cross section is substantially rectangular, and its proximal end portion 32 is joined by welding to the leading end face 57 (a leading-end side surface of a cylindrical portion 55) of the metal shell 50. In addition, the leading end portion 31 of the ground electrode 30 is bent such that its inner surface 33 faces the leading end portion 22 of the center electrode 20, and a spark discharge gap is formed between an electrode tip 92 joined to the inner surface 33 and the precious metal tip 91 joined to the leading end portion 22 of the center electrode 20.

Next, a description will be given of the metal shell 50. As shown in FIGS. 1 and 2, the metal shell 50 is a cylindrical fitting for fixing the spark plug 100 to the engine head 200 of an internal combustion engine. The metal shell 50 holds within its cylindrical hole 59 the insulator 10 so as to surround the portion from the long leg portion 13 to the collar portion 19 in a state in which the leading end portion 11 of the insulator 10 protrudes from the leading end face 57 of the metal shell 50. The metal shell 50 is made of low carbon steel, and has the large-diameter mounting portion 52 formed from its substantial center to the rear end side. An external thread 60 is formed on the outer peripheral surface of the mounting portion 52 at a portion extending from the substantial center toward the rear end. The external thread 60 threadedly engages an internal thread 202 formed on an inner peripheral surface of a large-diameter portion 201 (which is on a side distant from the combustion chamber 210) of a mounting hole 205 of the engine head 200 provided on an upper portion of the internal combustion engine, thereby fixing the metal shell 50 in the mounting hole 205. It should be noted that the metal shell 50 may be made of a material such as stainless steel or INCONEL with emphasis on selection of heat resistance.

The cylindrical portion 55 having a smaller diameter than that of the mounting portion 52 is provided forwardly of the mounting portion 52. When the spark plug 100 is mounted in the mounting hole 205 of the engine head 200, the cylindrical portion 55 is disposed within a small-diameter portion 203 at a position closer to the combustion chamber 210 side than the large-diameter portion 201 of the mounting hole 205. Further, a tapered seal portion 54 is formed between the cylindrical portion 55 and the mounting portion 52. This seal portion 54 abuts a stepped portion 204 having a tapered form arranged between the small-diameter portion 203 and the large-diameter portion 201 of the mounting hole 205 so as to prevent gastightness failure within the combustion chamber 210 through the mounting hole 205.

In addition, a tool engagement portion 51, to which an unillustrated spark wrench is fitted, is formed at the rear end side of the mounting portion 52. A thin-walled crimping portion 53 is provided rearwardly of the tool engagement portion 51, and a thin-walled buckled portion 58 is formed between the tool engagement portion 51 and the mounting portion 52. Meanwhile, a shelf portion 56 is formed on an inner peripheral surface of the cylindrical hole 59 at a position where the cylindrical portion 55 is formed, the shelf portion 56 being provided circumferentially on the inner peripheral surface so as to project inwardly in the form a shelf. When the insulator 10 is held inside the cylindrical hole 59, the stepped portion 15 of the insulator 10 is supported by the shelf portion 56 by means of a plate packing 8. Further, as an end portion of the crimping portion 53 is crimped by being inwardly bent, the inner surface side of the crimping portion 53 abuts the collar portion 19 of the insulator 10 to press the insulator 10 toward the leading end side inside the metal shell 50. At the time of crimping, the buckled portion 58 is heated and is deformed so as to swell in conjunction with the addition of a compressive force. As a result, the insulator 10 is reliably clamped and held between the crimping portion 53 and the shelf portion 56 inside the cylindrical hole 59, and the metal shell 50 and the insulator 10 are thereby integrated. The gastightness between the metal shell 50 and the insulator 10 is maintained by the plate packing 8 to prevent the efflux of combustion gases through the cylindrical hole 59.

In the spark plug 100 in accordance with this embodiment having the above-described structure, the cylindrical portion 55 formed forwardly of the mounting portion 52 of the metal shell 50 is formed integrally with the mounting portion 52, so that axial misalignment is avoided between the cylindrical portion 55 and the mounting portion 52. As a result, even if accuracy in the diametrical difference between the inner peripheral surface of the mounting hole 205 and the outer peripheral surface of the metal shell 50 is increased, and the clearance between them is made small, the mounting of the spark plug 100 in the mounting hole 205 is not made difficult. Incidentally, in a process in which the heat produced by combustion of fuel in the combustion chamber 210 and transferred to the metal shell 50 is allowed to escape from the metal shell 50 to the engine head 200, the transfer of heat takes place advantageously at portions where the engine head 200 and the metal shell 50 are in close contact with one another. Namely, as shown in FIG. 2, the mounting hole 205 and the metal shell 50 are in close contact with each other between the seal portion 54 of the metal shell 50 and the stepped portion 204 of the mounting hole 205 and between the external thread 60 of the mounting portion 52 of the metal shell 50 and the internal thread 202 of the large-diameter portion 201 of the mounting hole 205, such that heat dissipation is advantageously carried out at these portions. In this embodiment, by providing the cylindrical portion 55 at the leading end side of the metal shell 50, the seal portion 54 and the external thread 60 are located away from the combustion chamber 210 side as compared with a case where the cylindrical portion 55 is not present. Accordingly, since the route of heat transfer through the metal shell 50 becomes long in effecting heat dissipation through the seal portion 54 and the external thread 60, there is a possibility of a decrease in heat dissipation performance. Accordingly, the size and arrangement relationship of various portions are defined so that heat dissipation can be effected efficiently from the cylindrical portion 55 as well, in addition to heat dissipation from the seal portion 54 and the external thread 60.

First, heat dissipation from the cylindrical portion 55 to the small-diameter portion 203 of the mounting hole 205 can be effected over a wide range by elongating the length of the cylindrical portion 55 in the direction of the axis O. Specifically, the length B of the cylindrical portion 55 in the direction of the axis O is configured to be longer than the length A of the external thread 60 formed on the mounting portion 52. When the relationship A<B is satisfied, the desired contact length range, at least between the external thread 60 and the mounting hole 205, can be secured by locating the cylindrical portion 55 closer to the combustion chamber 210 than the external thread 60. Additionally, as the outer peripheral surface of the cylindrical portion 55 faces the inner peripheral surface of the small-diameter portion 203 of the mounting hole 205 with a wide range, i.e., with a wide area, it is possible to provide a configuration allowing for efficient heat dissipation. In measuring the length A of the external thread 60, both starting ends of the external thread 60 provided on the mounting portion 52 in the direction of the axis O are used as reference points. Meanwhile, in measuring the length B of the cylindrical portion 55, the leading end face 57 (i.e., corresponding to a leading end face of the cylindrical portion 55) of the metal shell 50 and a boundary between the cylindrical portion 55 and the seal portion 54 in the direction of the axis O are used as reference points.

In addition, in this embodiment, since the cylindrical portion 55 and the mounting portion 52 of the metal shell 50 are integrally constructed, axial misalignment is avoided and does not occur between the mounting portion 52 and the cylindrical portion 55. Furthermore, since the buckled portion 58 is disposed rearwardly of the mounting portion 52, even if the buckled portion 58 is deformed at the time of crimping of the crimping portion 53, the positional relationship between the mounting portion 52 and the cylindrical portion 55 remains unchanged such that axial misalignment is not introduced therebetween. By virtue of the structure in which axial misalignment between the mounting portion 52 and the cylindrical portion 55 is thus prevented, a configuration becomes possible in which the clearance between the inner peripheral surface of the small-diameter portion 203 of the mounting hole 205 and the outer peripheral surface of the cylindrical portion 55 of the metal shell 50 is made small, bringing the two surfaces close to one another. In addition, since entry of foreign substances such as combustion gases and soot into the clearance can be made difficult, heat dissipation becomes possible without causing a reduction in heat transfer efficiency. Accordingly, as heat dissipation is effected through the seal portion 54 and the external thread 60, as described above, heat from the combustion chamber 210 is transferred through the interior of the cylindrical portion 55. In this process it becomes possible to allow part of the heat to escape from the cylindrical portion 55 to the small-diameter portion 203 of the mounting hole 205.

In addition, on the basis of the results of Examples 1 and 2, described below, the present inventors found that it is desirable that once the length A of the external thread 60 and the cylindrical portion 55 satisfy the relationship A<B, A has a length of 10 to 20 mm and B has a length of 12 to 30 mm. If the length A of the external thread 60 becomes too small, the area of contact between the external thread 60 and the internal thread 202 of the mounting hole 205 becomes relatively small. According to Example 1 described below, the present inventors found that if the length A of the external thread 60 becomes smaller than 10 mm, in particular, in a case where the spark plug 100 is screwed into the engine head 200 with a specified tightening torque, the surface pressure occurring between the contact surfaces of the external thread 60 and the internal thread 202 becomes large. As a result, plastic deformation can possibly occur in the external thread 60 or the internal thread 202. In that case, it becomes difficult to maintain the surface pressure between the external thread 60 and the internal thread 202, in which case some play (looseness) can be introduced in the tightened state, making it difficult to maintain gastightness of the interior of the combustion chamber 210 through the mounting hole 205.

Meanwhile, since the materials of the metal shell 50 and the engine head 200 are generally different, their coefficients of thermal expansion differ. Consequently, a difference occurs between the overall elongation of the external thread 60 and the overall elongation of the internal thread 202 due to heating while operating the engine. In general, in the case where tightening of the thread is carried out, the closer to the rear end side in the direction of the axis O the thread portion is formed, the greater the surface pressure that is applied thereto. If a thermal load is applied in this state, the external thread and the internal thread are respectively elongated with that portion set as an origin. Furthermore, the closer to the leading end side in the direction of the axis O, the closer the thread portion is to the combustion chamber 210 and the higher the temperature, so that the difference in elongation due to the difference in the coefficient of thermal expansion becomes large. For this reason, the closer to the leading end side in the direction of the axis O the external thread 60 is formed, the larger its deviation from the internal thread 202 and a strong surface pressure is applied. The longer the length A of the external thread 60, the more noticeable this deviation is. According to Example 1 described below, the present inventors found that if the length A of the external thread 60 becomes greater than 20 mm, a large surface pressure is applied to the external thread 60 at the leading end side in the direction of the axis O. Also, plastic deformation results, in which case looseness or play can occur in the tightened state in the same way as described above, making it difficult to maintain gastightness.

In addition, if the length B of the cylindrical portion 55 is made small, the route of heat transfer within the cylindrical portion 55 becomes short. Consequently, this arrangement is advantageous in carrying out heat dissipation of the cylindrical portion 55 itself. However, in the above heat transfer route, since the amount of heat conducted from the cylindrical portion 55 to the small-diameter portion 203 side of the engine head 200 becomes small, the amount of heat conducted from the cylindrical portion 55 to the stepped portion 204 side of the engine head 200 through the seal portion 54 becomes relatively large. The heat received by the insulator 10 is transferred to the metal shell 50 side through the shelf portion 56, converges with the heat transfer route of the cylindrical portion 55 itself, and is dissipated to the engine head 200 side through the seal portion 54. For this reason, if the amount of heat from the cylindrical portion 55 flowing into the seal portion 54 is made too large, the amount of heat flowing into the seal portion 54 from the insulator 10 through the shelf portion 56 becomes relatively small. In other words, since the amount of heat from the cylindrical portion 55 to be handled by the seal portion 54 increases, the amount of heat from the insulator 10 which can be handled by the seal portion 54 becomes relatively small. For this reason, there is a possibility that dissipation of heat from the insulator 10 cannot be sufficiently accomplished.

Particularly, in a configuration in which the seal portion 54 is disposed forwardly of the shelf portion 56 in the direction of the axis O, the length of the cylindrical portion 55 becomes relatively short. Consequently, most of the heat from the cylindrical portion 55 flows into the seal portion 54. Since the heat transfer route in the cylindrical portion 55 becomes short, the heat dissipation of the cylindrical portion 55 becomes satisfactory. However, on the other hand, it becomes further difficult to dissipate the heat from the insulator 10 through the seal portion 54. In order to increase the amount of heat from the insulator 10 which can be dissipated through the seal portion 54, it suffices if part of the heat in the cylindrical portion 55 itself is allowed to escape to the small-diameter portion 203 side by appropriately setting the length B of the cylindrical portion 55. Consequently, the amount of heat from the cylindrical portion 55 flowing into the seal portion 54 is thereby reduced. Specifically, on the basis of Example 2 described below, it is sufficient if the length B of the cylindrical portion 55 is set to not less than 12 mm.

Meanwhile, to allow the heat to efficiently escape from the cylindrical portion 55 to the small-diameter portion 203 side, the inner peripheral surface of the mounting hole 205 and the outer peripheral surface of the cylindrical portion 55 should preferably be disposed in close proximity to one another. For this purpose, it is necessary to prevent axial misalignment between the mounting portion 52 and the cylindrical portion 55 in the metal shell 50. However, the larger the length of the cylindrical portion 55, the higher the required forming accuracy in the fabrication of the metal shell 50 to prevent axial misalignment therebetween. If axial misalignment occurs, a portion of the outer peripheral surface of the cylindrical portion 55 comes into contact with the inner peripheral surface of the mounting hole 205, so that the gap between the two surfaces becomes large at a portion opposite the contacting portion. Further, the ingress of soot and the like is facilitated, possibly leading to seizure between the outer peripheral surface of the cylindrical portion 55 and the inner peripheral surface of the mounting hole 205. According to Example 2, described below, in order to prevent axial misalignment between the mounting portion 52 and the cylindrical portion 55 and to maintain the forming accuracy at a high level, specifically, the length B of the cylindrical portion 55 is preferably set to not more than 30 mm.

Next, in this embodiment, the configuration provided is such that, in the direction of the axis O, the length B of the cylindrical portion 55 is set to be greater than the length C from the leading end position (leading end face 14) of the insulator 10 to the position where the shelf portion 56 is formed. Namely, the shelf portion 56 is formed on the inner peripheral surface of the cylindrical hole 59 at a shelf forming position of the cylindrical portion 55. Although both the metal shell 50 and the insulator 10 are heated by combustion of fuel in the combustion chamber 210, heat is transmitted by the shelf portion 56 from the stepped portion 15 of the insulator 10 to the metal shell 50 through the plate packing 8 and is thereby allowed to escape to the engine head 200. Since the shelf portion 56 through which the heat from the insulator 10 flows into the metal shell 50 side is provided on the cylindrical portion 55 which is likely to assume a relatively low temperature (because heat dissipation is effected through its outer peripheral surface), as described above, it becomes possible for the heat from the insulator 10 to flow smoothly into the cylindrical portion 55 side. In addition, since the seal portion 54 is located rearwardly of the shelf portion 56 in the direction of the axis O, the heat transfer route at its converging position is located away from the combustion chamber 210, i.e., the heat source, heat transfer can be carried out smoothly, and heat dissipation of the insulator 10 can be accomplished more effectively.

Since the cylindrical portion 55 is disposed at a position close to the combustion chamber 210 constituting the heat source, heat dissipation from the insulator 10 to the metal shell 50 side is carried out via a relatively short route and at a relatively early stage. As described above, in the configuration in which the seal portion 54 is disposed forwardly of the shelf portion 56 in the direction of the axis O, the heat dissipation in the cylindrical portion 55 to the engine head 200 side becomes satisfactory, but the heat dissipation from the insulator 10 to the metal shell 50 side becomes difficult. On the basis of Example 3 described below, it suffices if the length C in the direction of the axis O from the leading end face 14 of the insulator 10 to the forming position of the shelf portion 56 is set to not more than 12 mm. It should be noted that, as for the forming position of the shelf portion 56, the position of a center of its surface opposing the stepped portion 15 of the insulator 10 via the plate packing 8 is set as a reference.

The following evaluation tests were conducted to confirm that the effects of the invention are obtained by setting the length A of the external thread 60, the length B of the cylindrical portion 55, and the length C from the leading end face 14 of the insulator 10 to the forming position of the shelf portion 56 in the direction of the axis O, as provided herein.

Example 1

First, a test was conducted to evaluate the effect of changing the length A of the external thread 60 in the direction of the axis O. In this evaluation test, six spark plug Sample Nos. 1-1 to 1-6 were fabricated in which the sizes of the respective portions were adjusted such that the length B of the cylindrical portion was fixed to 22 mm, the length C from the leading end face of the insulator to the forming position of the shelf portion was fixed to 12 mm, and only the length A of the external thread was variously set at 8, 10, 11.7, 15, 20 and 23 (mm).

Then, after the respective samples were screwed with a specified torque into aluminum bushings (simulating the mounting hole of an engine head) fabricated from aluminum material, confirmation of the presence or absence of the deformation of the external thread was conducted by measuring the loosening torque (torque required for removing the metal shell). Next, after the samples for which deformation was not noted in the external thread were screwed again into the aluminum bushings with the specified torque, and a thermal load (held in a 200° C. constant temperature bath for 1 hour and subsequently allowed to cool naturally) was applied, confirmation of the presence or absence of deformation of the external thread was conducted by measuring the loosening torque in a similar manner. The results of this evaluation test are shown in Table 1 below.

TABLE 1

| Sample No. | A (mm) | B (mm) | C (mm) | Magnitude Relation | Deformation of External Thread | Deformation of External Thread After Thermal Test | Overall Evaluation |
|---|---|---|---|---|---|---|---|
| 1-1 | 8 | 22 | 12 | A < B | present | — | X |
| 1-2 | 10 | | | A < B | absent | absent | ○ |
| 1-3 | 11.7 | | | A < B | absent | absent | ○ |
| 1-4 | 15 | | | A < B | absent | absent | ○ |

TABLE 1-continued

| Sample No. | A (mm) | B (mm) | C (mm) | Magnitude Relation | Deformation of External Thread | Deformation of External Thread After Thermal Test | Overall Evaluation |
|---|---|---|---|---|---|---|---|
| 1-5 | 20 | | | A < B | absent | absent | ○ |
| 1-6 | 23 | | | A > B | absent | present | X |

As shown in Table 1, in Sample No. 1-1 in which A was 8 mm, deformation occurred in the external thread after tightening with the specified torque. However, in Sample Nos. 1-2 to 1-6 in which A was not less than 10 mm, no deformation of the external thread was observed. In Sample No. 1-1, since A was not provided with a sufficient length, it was impossible to secure a sufficient area of contact with the internal thread of the mounting hole. Also, since the surface pressure applied to the contact portions of the two threads became greater due to tightening with the specified torque in comparison with the other samples, plastic deformation was observed in the external thread.

In addition, in Sample No. 1-6 in which A was 23 mm, deformation occurred in the external thread after application of a thermal load. However, in Sample Nos. 1-2 to 1-5 in which A was not less than 10 mm and not more than 20 mm, no deformation of the external thread was observed. In general, in the case where the tightening of the thread is carried out, the closer the thread portion is to the rear end side in the direction of the axis O, the greater the surface pressure that is applied thereto. If a thermal load is applied in this state, the metal shell and the aluminum brush are respectively elongated by thermal expansion. However, the closer to the leading end side in the direction of the axis O (and therefore closer to the combustion chamber), the higher the temperature and the greater the difference in elongation due to the difference in coefficient of thermal expansion. At this time, the external thread at the rear end side in the direction of the axis O is in a state of close contact with the internal thread of the mounting hole. If the external thread and the internal thread are elongated with this point serving as an origin, the deviation between the external thread and the internal thread becomes large at the leading end side in the direction of the axis O, and a strong surface pressure is applied. The longer the length A, the more noticeable the deviation. Therefore, in Sample 1-6 in which A was 23 mm, plastic deformation occurred in the external thread at the leading end side.

From the result of this evaluation test, Sample Nos. 1-1 and 1-6 in which deformation occurred in the external thread were graded "x" in the overall evaluation due to the length A of the external thread being outside the above-prescribed preferred range. Meanwhile, Sample Nos. 1-2 to 1-5 in which no deformation was observed in the external thread were graded "○" in the overall evaluation due to selection of the length A of the external thread within the above-prescribed preferred range.

Example 2

Next, a test was conducted to confirm the effect of changing the length B of the cylindrical portion in the direction of the axis O. In this evaluation test, six spark plug Sample Nos. 2-1 to 2-6 were fabricated in which the sizes of the respective portions were adjusted such that the length A of the external thread was fixed to 11.7 mm, the length C from the leading end face of the insulator to the forming position of the shelf portion was fixed to 12 mm, and only the length B of the cylindrical portion was variously set at 10, 12, 17, 22, 30 and 33 (mm).

Engine heads which were respectively fabricated in conformity with these samples were sequentially assembled to a test engine having a displacement of 1,600 cc. After each sample was mounted, an operation test was conducted in which the spark timing was advanced sequentially by increments of two degrees using a proper ignition timing as a reference, and the engine was held for 2 minutes at 5,500 rpm on each occasion. Those samples in which pre-ignition occurred at an advanced angle in the range of 40 to 42 degrees were evaluated as having excellent heat resistance and were graded "○". Those samples in which pre-ignition occurred at a smaller advanced angle were evaluated as having poor heat resistance and were graded "X". Evaluations were also made on mountability and demountability of the various samples in the engine head. As for mountability, those samples which could not be easily mounted due to the occurrence of seizing were graded "X", and those samples which were easily mounted without seizing were graded "○". Further, after conducting the aforementioned evaluation test of heat resistance, the loosening torque at the time of demounting each sample was respectively measured, and a comparison was made with the specified torque at the time of mounting. Those samples in which the loosening torque was 95% or more with respect to the specified torque were graded "x" by judging that soot and the like had entered between the outer peripheral surface of the cylindrical portion and the inner peripheral surface of the mounting hole. Meanwhile, those samples in which the loosening torque was less than 95% with respect to the specified torque were graded "○" by judging that seizing did not occur. The results of this evaluation test are shown in Table 2 below.

TABLE 2

| Sample No. | A (mm) | B (mm) | C (mm) | Magnitude Relation | Heat Resistance | Mountability | Demountability | Overall Evaluation |
|---|---|---|---|---|---|---|---|---|
| 2-1 | 11.7 | 10 | 12 | A > B | X | ○ | ○ | X |
| 2-2 | | 12 | | A < B | ○ | ○ | ○ | ○ |
| 2-3 | | 17 | | A < B | ○ | ○ | ○ | ○ |
| 2-4 | | 22 | | A < B | ○ | ○ | ○ | ○ |
| 2-5 | | 30 | | A < B | ○ | ○ | ○ | ○ |

TABLE 2-continued

| Sample No. | A (mm) | B (mm) | C (mm) | Magnitude Relation | Heat Resistance | Mountability | Demountability | Overall Evaluation |
|---|---|---|---|---|---|---|---|---|
| 2-6 | | 33 | | A < B | ○ | ○ | X | Δ |

As shown in Table 2, in Sample No. 2-1 in which B was 10 mm, pre-ignition occurred at an advanced angle smaller than 40 degrees. In Sample No. 2-1, A>B. Although the heat dissipation of Sample No. 2-1 in the cylindrical portion itself was effected satisfactorily through the seal portion, since B was small, practically no heat dissipation was effected through its outer peripheral surface. Namely, most of the heat from the cylindrical portion flowed into the seal portion, so that the amount of heat from the cylindrical portion to be handled in the seal portion increased. For this reason, the amount of heat from the insulator which could be handled by the seal portion became relatively small, so that the dissipation of heat from the insulator was difficult to effect. Accordingly, this sample was graded by "x" since the desired heat resistance could not be obtained.

In addition, as for mountability when mounting the respective samples in the engine head, since the samples could be mounted without the occurrence seizing, all of the samples were graded "O". However, in Sample No. 2-6 in which B was set to 33 mm, the loosening torque was 110% at 22 N·m with respect to a specified torque of 20 N·m. Since the loosening torque was 95% or more, Sample No. 2-6 is graded "x". In Sample Nos. 2-1 to 2-5 in which B was not less than 12 mm and not more than 30 mm, the loosening torque with respect to the specified torque was less than 95%. Therefore, these samples were graded "O".

As a result of these evaluation tests, Sample No. 2-1, in which B was 10 mm and for which sufficient heat resistance and satisfactory performance could not be obtained, was assigned an overall evaluation grade of "x". In addition, Sample No. 2-6, in which B was 33 mm and which exhibited difficulty in demounting but which presented no problem in terms of heat resistance, was assigned an overall evaluation grade of "A". Further, Sample Nos. 2-2 to 2-5 in which B was not less than 12 mm and not more than 30 mm presented no particular problem, and therefore these samples were assigned an overall evaluation grade of "O".

Example 3

Next, an evaluation test was conducted to evaluate the effect of changing the length C from the leading end face of the insulator to the forming position of the shelf portion. In this evaluation test, three spark plug Sample Nos. 3-1 to 3-3 were fabricated in which the sizes of the respective portions were adjusted such that the length A of the external thread was fixed to 11.7 mm, the length B of the cylindrical portion was fixed to 14 mm, and only the length C from the leading end face of the insulator to the forming position of the shelf portion was variously set at 9, 12 and 15 (mm).

Then, in the same way as in Example 2, these samples were sequentially mounted in a test engine having a 1,600 cc displacement. An operation test was conducted in which the spark timing was advanced sequentially by increments of two degrees using a proper ignition timing as a reference, and the engine was held for 2 minutes at 5,500 rpm on each occasion. Those samples in which pre-ignition occurred at an advanced angle in the range of 40 to 42 degrees were evaluated as having excellent heating resistance and were graded "○". Those samples in which pre-ignition occurred at a smaller advanced angle were evaluated as having poor heat resistance and were graded "x". The results of the evaluation test are shown in Table 3 below.

TABLE 3

| Sample No. | A (mm) | B (mm) | C (mm) | Magnitude Relation | Heat Resistance |
|---|---|---|---|---|---|
| 3-1 | 11.7 | 14 | 9 | B > C | ○ |
| 3-2 | | | 12 | B > C | ○ |
| 3-3 | | | 15 | B < C | X |

As shown in Table 3, in Sample No. 3-3, C was set to 15 mm, B<C, and a configuration where the seal portion was disposed forwardly of the shelf portion in the direction of the axis O was adopted. In this configuration, if the length B of the cylindrical portion is short, the amount of heat from the cylindrical portion to be dissipated in the seal portion increases. Consequently, heat dissipation from the insulator is impaired, as described above. Even if the length B of the cylindrical portion has a size sufficient to accommodate the heat dissipation through the outer peripheral surface of the cylindrical portion, if C becomes large as in Sample No. 3-3, the route for transferring (within the insulator) heat received by the insulator becomes disadvantageously long, so that the heat resistance of the insulator itself decreases. In Sample No. 3-3, pre-ignition occurred at a smaller advanced angle (30 to 32 degrees) than 40 degrees. Thus, the desired heat resistance could not be obtained, such that Sample No. 3-3 was graded "x".

Meanwhile, in Sample Nos. 3-1 and 3-2 in which C was not more than 12 mm, since C is relatively small, the heat received by the insulator can readily escape to the metal shell side through the shelf portion at an early stage. Here, if the length B of the cylindrical portion has a size sufficient to accommodate heat dissipation through the outer peripheral surface of the cylindrical portion, the cooling performance of the cylindrical portion itself can be maintained at a high level. Consequently, the heat from the insulator can be sufficiently dissipated to the cylindrical portion side. In Sample Nos. 3-1 and 3-2, pre-ignition occurred at advanced angles of 50 to 52 degrees and 40 to 42 degrees, respectively, and the desired heat resistance plug could be obtained, such that these samples were graded "O".

It should be noted that various modifications of the invention are contemplated. For example, although the external thread 60 is formed on a portion (at a position from the substantial center toward the rear end side) of the mounting portion 52, the external thread 60 may be formed at an arbitrary position in the mounting portion 52, or may be formed not on a part but rather on the entirety thereof.

In addition, the shelf portion 56 may assume a stepped form. The shelf portion 56 may be freely configured, so long as it is able to support the stepped portion 15 of the insulator 10 within the cylindrical hole 59 of the metal shell 50 in the direction of the axis O.

It should further be apparent to those skilled in the art that various changes in form and detail of the invention as shown and described above may be made. It is intended that such changes be included within the spirit and scope of the claims appended hereto.

This application is based on Japanese Patent Application No. JP 2006-242332, filed Sep. 7, 2006, and Japanese Patent Application No. JP 2007-204941, filed Aug. 7, 2007, the entire contents of which are hereby incorporated by reference, the same as if set forth at length.

What is claimed is:

1. A spark plug comprising:

a center electrode;

an insulator having an axial hole extending in an axial direction of said spark plug, said insulator holding the center electrode at a leading end side within the axial hole; and a metal shell having a cylindrical hole extending in the axial direction, said metal shell holding at least a portion of the insulator within the cylindrical hole, wherein the metal shell comprises:

a mounting portion having an external thread formed on at least a portion of an outer peripheral surface thereof for engaging an internal thread of a mounting hole of an internal combustion engine;

a cylindrical portion formed integrally with the mounting portion at a leading end side thereof and having a smaller diameter than that of the mounting portion;

a tapered seal portion connecting outer peripheral surfaces of the cylindrical portion and the mounting portion, the tapered seal portion being spaced apart from the external thread in the axial direction;

a crimping portion provided at a rear end of the metal shell, said crimping portion holding the insulator within the cylindrical hole by crimping; and a buckled portion provided between the mounting portion and the crimping portion, and adapted to be deformed in conjunction with the crimping of the crimping portion, and a relationship A<B is satisfied, in which A is a length in the axial direction of the external thread formed on the mounting portion, and B is a length of the cylindrical portion in the axial direction.

2. The spark plug as claimed in claim 1, comprising a shelf portion provided on an inner peripheral surface of the cylindrical hole projecting inwardly, said shelf portion clamping the insulator in the axial direction in cooperation with the crimping portion, and wherein a relationship B>C is satisfied, in which C is a length in the axial direction from a leading end of the insulator to a position where the shelf portion is formed.

3. The spark plug as claimed in claim 2, wherein the seal portion of the metal shell is located rearwardly of the shelf portion in the axial direction.

4. The spark plug according to claim 2, wherein the length A of the external thread in the axial direction is from 10 mm to 20 mm, the length B of the cylindrical portion of the metal shell in the axial direction is from 12 mm to 30 mm, and the length C in the axial direction from the leading end of the insulator to the position where the shelf portion is formed is 12 mm or less.

5. The spark plug according to claim 3, wherein the length A of the external thread in the axial direction is from 10 mm to 20 mm, the length B of the cylindrical portion of the metal shell in the axial direction is from 12 mm to 30 mm, and the length C in the axial direction from the leading end of the insulator to the position where the shelf portion is formed is 12 mm or less.

6. A spark plug comprising:

a center electrode;

an insulator having an axial hole extending in an axial direction of said spark plug, said insulator holding the center electrode at a leading end side within the axial hole; and a metal shell having a cylindrical hole extending in the axial direction, said metal shell holding at least a portion of the insulator within the cylindrical hole, wherein the metal shell comprises:

a mounting portion having an external thread formed on at least a portion of an outer peripheral surface thereof for engaging an internal thread of a mounting hole of an internal combustion engine;

a cylindrical portion formed integrally with the mounting portion at a leading end side thereof and having a smaller diameter than that of the mounting portion;

a tapered seal portion being spaced apart from the external thread connecting outer peripheral surfaces of the cylindrical portion and the mounting portion, the tapered seal portion being spaced apart from the external thread in the axial direction;

a crimping portion provided at a rear end of the metal shell, said crimping portion holding the insulator within the cylindrical hole by crimping, wherein a relationship A<B is satisfied, in which A is a length in the axial direction of the external thread formed on the mounting portion, and B is a length of the cylindrical portion in the axial direction.

7. The spark plug as claimed in claim 6, comprising a shelf portion provided on an inner peripheral surface of the cylindrical hole projecting inwardly, said shelf portion clamping the insulator in the axial direction in cooperation with the crimping portion, and wherein a relationship B>C is satisfied, in which C is a length in the axial direction from a leading end of the insulator to a position where the shelf portion is formed.

8. The spark plug as claimed in claim 7, wherein the seal portion of the metal shell is located rearwardly of the shelf portion in the axial direction.

9. The spark plug according to claim 7, wherein the length A of the external thread in the axial direction is from 10 mm to 20 mm, the length B of the cylindrical portion of the metal shell in the axial direction is from 12 mm to 30 mm, and the length C in the axial direction from the leading end of the insulator to the position where the shelf portion is formed is 12 mm or less.

10. The spark plug according to claim 8, wherein the length A of the external thread in the axial direction is from 10 mm to 20 mm, the length B of the cylindrical portion of the metal shell in the axial direction is from 12 mm to 30 mm, and the length C in the axial direction from the leading end of the insulator to the position where the shelf portion is formed is 12 mm or less.

* * * * *